US006443229B1

(12) United States Patent
Kulka

(10) Patent No.: US 6,443,229 B1
(45) Date of Patent: Sep. 3, 2002

(54) METHOD AND SYSTEM FOR EXTRACTION OF LIQUID HYDRAULICS FROM SUBTERRANEAN WELLS

(76) Inventor: Daniel S. Kulka, 59 Newman Rd., Williamston, MI (US) 48895

( * ) Notice: Subject to any disclaimer, the term of this patent is extended or adjusted under 35 U.S.C. 154(b) by 0 days.

(21) Appl. No.: 09/532,421

(22) Filed: Mar. 23, 2000

(51) Int. Cl.[7] ..... E21B 43/16
(52) U.S. Cl. ..... 166/268; 166/52; 166/370
(58) Field of Search ..... 166/268, 52, 370

(56) References Cited

U.S. PATENT DOCUMENTS

| | | | | |
|---|---|---|---|---|
| 1,252,557 A | * | 1/1918 | Dunn | 166/268 |
| 2,048,731 A | * | 7/1936 | Doherty | 166/268 |
| 2,767,792 A | * | 10/1956 | Spearow | 166/268 |
| 3,295,601 A | | 1/1967 | Santourian | |
| 3,371,711 A | * | 3/1968 | Odeh | 166/268 |
| 3,411,583 A | | 11/1968 | Holm et al. | |
| 3,519,076 A | * | 7/1970 | Walker | 166/268 |
| 3,547,199 A | | 12/1970 | Froning et al. | |
| 3,995,693 A | | 12/1976 | Cornelius | |
| 4,183,405 A | * | 1/1980 | Magnie | 166/260 |
| 4,465,136 A | | 8/1984 | Troutman | |
| 4,501,328 A | * | 2/1985 | Nichols | 166/288 |
| 4,509,596 A | | 4/1985 | Emery | |
| 4,565,249 A | | 1/1986 | Pebdani et al. | |
| 4,628,999 A | * | 12/1986 | Kiss et al. | 166/274 |
| 5,065,821 A | | 11/1991 | Huang et al. | |
| 5,381,863 A | | 1/1995 | Wehner | |
| 5,402,847 A | | 4/1995 | Wilson et al. | |
| 5,413,177 A | | 5/1995 | Horton | |
| 5,663,121 A | | 9/1997 | Moody | |
| 5,725,054 A | | 3/1998 | Shayegi et al. | |
| 6,039,116 A | * | 3/2000 | Stevenson et al. | 166/263 |

OTHER PUBLICATIONS

Stoeppelwerth, George P., Oil & Gas Journal 68–69 (Apr. 26, 1993).
Shelton, Jack L., et al., Journal of Pertroleum Technology, 890–896 (1973).
Bardon, C.P., et al., Society of Petroleum Eng. U.S. Department of Energy, SPE/DOE 14943, 247–353 (1986).
Palmer, F. S., et al., Society of Petroleum Engineers (SPE 15497) (1986).
Monger, T.G., et al., SPE Reservoir Engineering, 1168–1176 (1988).
Haines, H.K., et al., International Technical Meeting, Paper #CIM/SPE (1990).
Johnson, H. R., et al., SPE/DOE 20269, pp. 933–939 (1990).
Monger, T.G., et al., SPE Reservoir Engineering 25–32 (1991).

* cited by examiner

*Primary Examiner*—Hoang Dang
(74) *Attorney, Agent, or Firm*—Ian C. McLeod

(57) ABSTRACT

A method and system for tertiary or enhanced oil recovery from a subterranean liquid hydrocarbon or oil wells is described. The method uses packers (104, 105, 204, 205, 304, 305, 305A, 305B) or angled wells (401) in order to force the gas down into the oil bearing strata (502) from a gas containing strata (501). The result is increased production of oil since the gas is forced downward over a large horizontal area between the gas containing strata and oil bearing strata.

15 Claims, 6 Drawing Sheets

METHOD AND SYSTEM FOR EXTRACTION OF LIQUID HYDRAULICS FROM SUBTERRANEAN WELLS

BACKGROUND OF THE INVENTION (1) Field of the Invention

The present invention relates to a process for enhanced oil recovery from subterranean liquid hydrocarbon or oil wells which usually have undergone primary liquid hydrocarbon (oil) removal and are pressure depleted. In particular the present invention relates to the injection of highly compressed cooled exhaust gas from an internal combustion engine into an injection well in a gas bearing strata so as to be directed downwardly to solubilize and drive the liquid hydrocarbons from an oil bearing strata to a separate production well. Also the present invention relates to the recycling of the exhaust gas removed from the production well with the oil into the injection well.

(2) Description of Related Art

A general discussion of enhanced oil recovery (EOR) is set forth in Kirk-Othmer Edition 17 168–174 (1982). The goal of EOR is to extract oil which is trapped in the sedimentary rock of the subterranean reservoir. The rock can be sandstone or carbonates, such as dolomite. Commonly, gases are used as a solvent and/or as a driving fluid. Carbon dioxide is usually used as the oil miscible, driving gas and nitrogen is an immiscible driving gas.

Prior art literature in enhanced recovery is as follows: Stoesppelwerth, George P., Oil & Gas Journal, 68–69 (Apr. 26, 1993); Shelton, Jack L., et al., Journal of Petroleum Technology, 890–896 (1973); Bardon, C. P., et al., Society of Petroleum Engineers, U.S. Department of Energy, SPE/DOE 14943, 247–253 (1986); Palmer, F. S., et al., Society of Petroleum Engineers (SPE 15497), (1986); Monger, T. G., et al., SPE Reservoir Engineering, 1168–1176 (1988); Haines, H. K., et al., International Technical Meeting, Paper #CIM/SPE (1990); Johnson, H. R., et al., SPE/DOE 20269, pages 933–939 (1990); Monger, T. G., et al., SPE Reservoir Engineering, 25–32 (1991).

Patents which are related are U.S. Pat. No. 3,295,601 to Santourian; U.S. Pat. No. 3,411,583 to Holm et al; U.S. Pat. No. 3,547,199 to Fronina et al; U.S. Pat. No. 3,841,406 to Burnett; U.S. Pat. No. 3,995,693 to Cornelius; U.S. Pat. No. 4,465,136 to Troutman; U.S. Pat. No. 4,509,596 to Emery; U.S. Pat. No. 4,656,249 to Pebdani et al; U.S. Pat. No. 5,381,863 to Weaner; U.S. Pat. No. 5,402,847 to Wilson et al; U.S. Pat. No. 5,065,821 to Hang et al; U.S. Pat. No. 5,413,177 to Horn; U.S. Pat. No. 5,725,054 to Shays et al; and U.S. Pat. No. 5,663,121 to Moody.

The prior art has described the use of exhaust gases from internal combustion engines for increasing hydrocarbon production. Illustrative is a system described by Stoesppelwerth in Oil/Gas Journal, April 1993 and an Internet listing by Energy, Inc. of Tulsa, Okla. In the latter case, a single well is used and a primary purpose is to unplug the openings in the production well. U.S. Pat. No. 4,465,136 to Troutman describes the use of exhaust gas with water flooding around the injection production well. The gas pressure in the reservoir is cycled between about 150–300 pounds/m$^2$, which is relatively low, and is referred to as "huff'n-puff". U.S. Pat. No. 5,381,863 to Wehner the carbon dioxide is initially immiscible in the oil at low pressures during injection and miscible at high pressures during extraction from the well.

U.S. Pat. No. 5,065,821 to Huana et al describes lateral drilling for gas injection. There is no use of any plugs in the wells and the well openings for injection and extraction are at the same level. U.S. Pat. No. 5,725,054 to Shayeai et al descries a method using steps of carbon dioxide injection separate from nitrogen injection.

There is a need for a more reliable method for the production of oil from pressure depleted reservoirs.

OBJECTS

It is therefore an object of the present invention to provide an improved method for enhanced oil recovery from a subterranean well. In particular, the present invention relates to a method which is relatively economical and reliable. Further, it is an object of the present invention to provide a method which is environmentally sound. These and other objects will become increasingly apparent by reference to the following description and the drawings.

SUMMARY OF THE INVENTION

The present invention relates to a method for enhanced recovery of hydrocarbons containing oil from a subterranean hydrocarbon bearing strata comprising the steps of:

(a) providing an exhaust gas from an internal combustion engine, which gas is compressed by a compressor connected to the engine motor, wherein the gas consists essentially of nitrogen and carbon dioxide;

(b) injecting the exhaust gas from the compressor into an injection well and from the injection well into a gas bearing strata which is above the hydrocarbon bearing strata, without injection of the exhaust gas directly into the hydrocarbon bearing strata from the injection well which increases pressure in the oil bearing strata; and (c) recovering the hydrocarbons and the exhaust gas from a production well in the hydrocarbon bearing strata.

Further the present invention relates to an oil producing well system for enhanced recovery of hydrocarbons including oil from a subterranean bearing strata which comprises:

(a) an injection well for injecting a compressed exhaust gas from an internal combustion engine, which is connected to a compressor for the exhaust gas, into a gas bearing strata which is above the hydrocarbon bearing strata, without injection of the exhaust gas directly into the hydrocarbon bearing strata from injection well;

(b) a production well in spaced relationship to the injection well and extending into the hydrocarbon bearing strata for recovering the exhaust gas and hydrocarbons from the hydrocarbon bearing strata; and (c) a separation facility above the production well for separating the hydrocarbons from the exhaust gas.

DESCRIPTION OF PREFERRED EMBODIMENTS

The present invention provides a method and system for the enhancement of oil recovery from mature, pressure depleted, subterranean formations via re-pressurization utilizing a gas stream mixture of nitrogen and carbon dioxide produced by an internal combustion engine. The exhaust gas is preferably has reduced acid and corrosion properties by the addition of neutralizing agents and cooled.

The recovery of the oil is from the subterranean formation containing oil, gas and/or water, penetrated by vertical or angled production and injection well bores, through reservoir repressurization. The subterranean formation is initially depleted of its natural pressure drive. Exhaust gases are preferably produced on-site by a mobile internal combustion engine(s), usually fueled by either diesel fuel or propane.

The method comprises the steps of injecting via the injector well bore a stream of an inert gas mixture produced by said internal combustion engines and with the reduced acid and corrosion characteristics prior to the injection. The inert gas is a mixture of nitrogen and carbon dioxide and contains trace amounts of other associated gases; carbon monoxide, hydrogen, oxygen, argon, hydrocarbons and other similar gases. The temperature of the gas at the well head is preferably between about 80° and 150° F. The gas is injected via a compressor into the injection well bore (s) in an amount and under pressures sufficient to establish either miscible, near-miscibility or immiscible conditions.

The injection well alone or with the production well is shut-in for a period of time to allow for reservoir stabilization, produced during the re-pressurization phase or produced immediately upon the completion of the injection phase. The oil is removed through the production well.

Gases produced through production well bore(s) are re-injected into subterranean formation via compressor and the injection well bore until such time as deemed uneconomical by the operator. Additional makeup gas may be used during the course of operation to maintain a desired bottom hole pressure.

Figure 1:
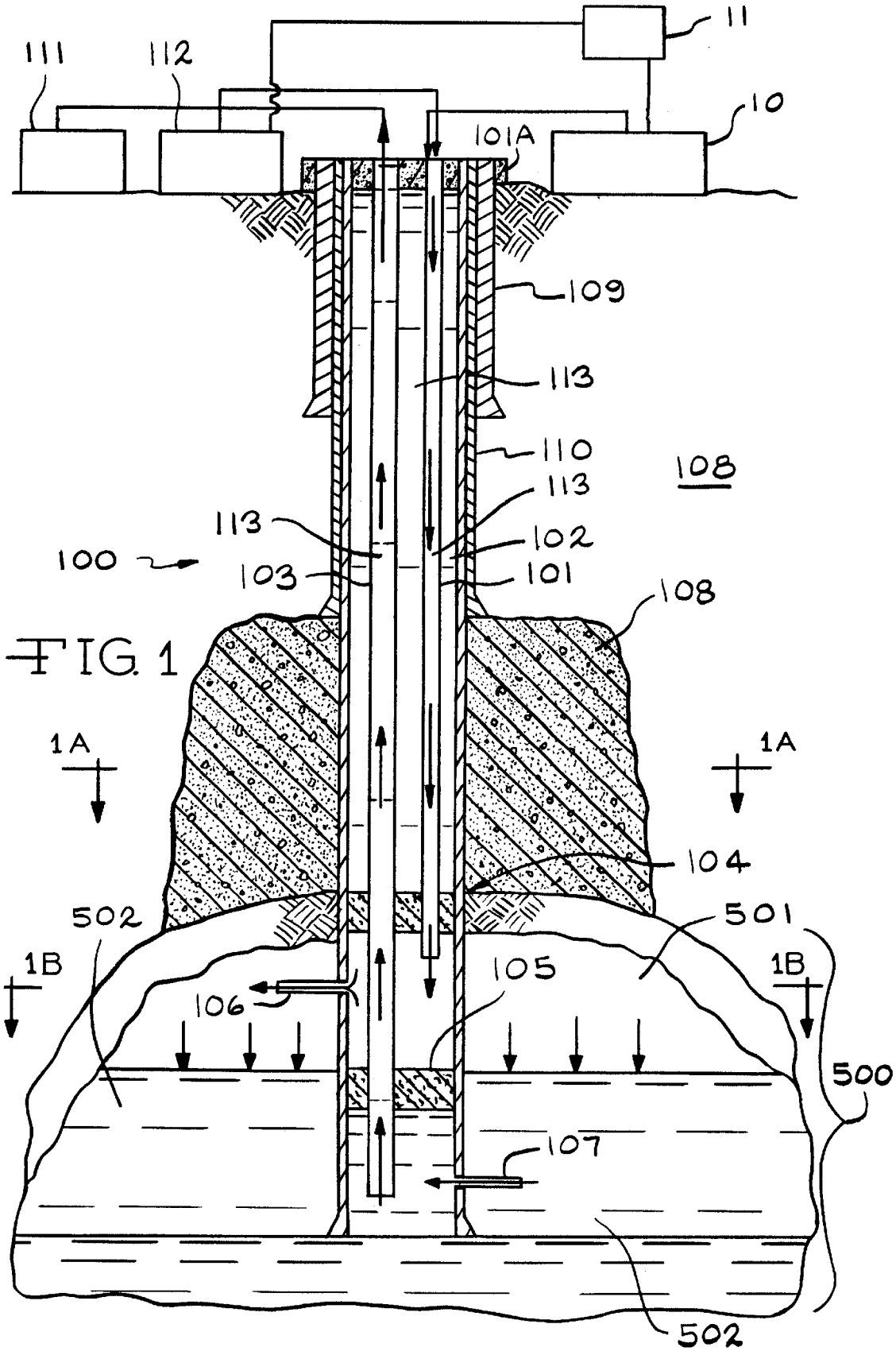
FIGS. 1 to 4 are front partial cross-sectional views of wells 100, 200, 300 and 400 for liquid hydrocarbon production.
Figure 1A:
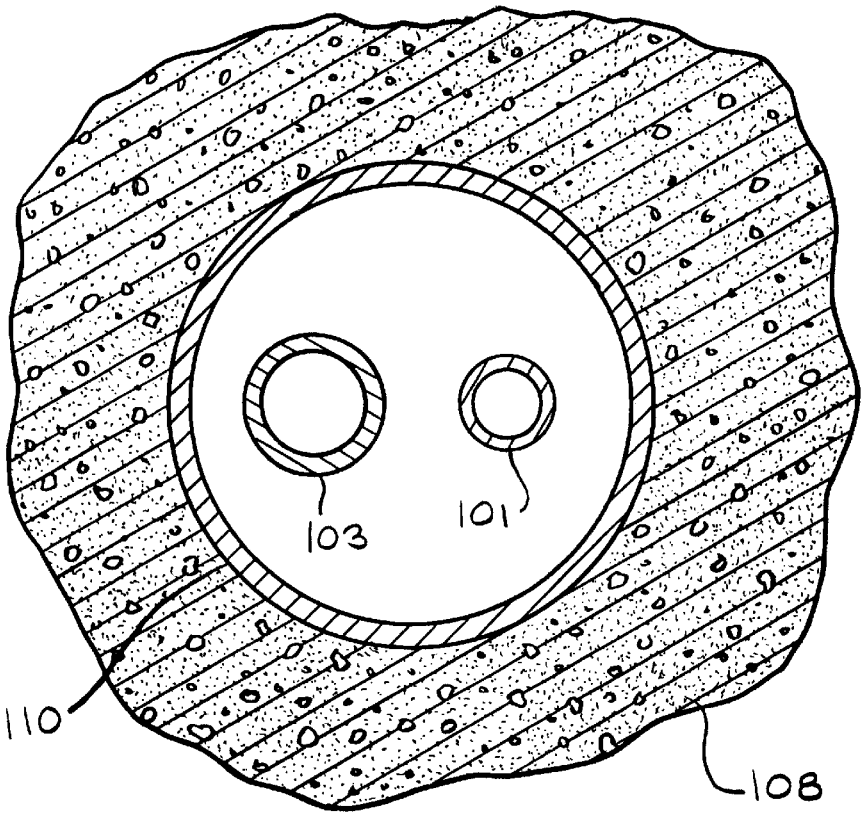
FIG. 1A and 1B are cross-sections along lines 1A—1A and 1B—1B of FIG. 1, respectively.
Figure 1B:
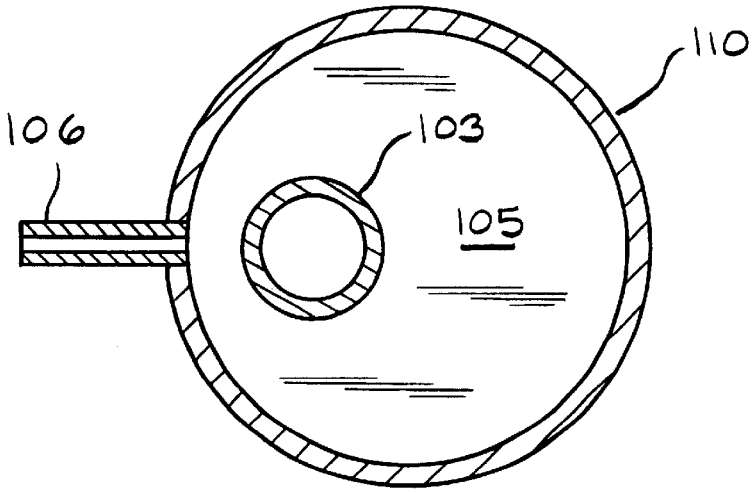

FIGS. 1 to 4 show various types of well systems 100, 200, 300 or 400 which can be used. Referring to FIG. 1, a strata 500 which has reduced production is injected with the gas from the unit 10 through injection well 101 in a casing 102. The well 101 is closed with cap 101A. The injection well 101 leads to the gas section 501 of a strata 500 above the oil section 502. The casing 102 leads to the bottom of the well, usually just above the water level below the strata 500. Adjacent to the injection well 101 in the casing 102 is a production well 103 which leads to the oil production section 502 below the gas section 501. In Michigan, the strata 500 is comprised of dolomite and limestone. The casing 102 is provided with retrievable packings 104 and 105 which are on either side of the gas section 501. A lateral well 106 for injection the gas into the gas section 501 is provided from the casing 102 above the packing 105 and below the packing 104. An oil production lateral well 107 is provided below the packing 105. The well is provided with a cement top 108 (about 500 feet above the strata 500). An outer casing 109 shields the ground water and generally extends in Michigan down below the fresh water table. A secondary inner casing 110 extends down to adjacent the formation at the level of the cement top 108. The annulus 113 between the casing 102 and wells 101 and 103 is optimally filled with fluid to prevent corrosion of the wells 101 and 103. The production well 103 is connected to a production facility 111 which processes the oil and recycles the exhaust gas extracted through a recycling compressor 112 into the injection well 101.

In operation the unit 10 generates gas which is injected via well 101 and lateral well 106 into the gas section 501. This causes pressure in the oil section 502 forcing the oil into production well 103 which is collected in production facility 111. The gas to the compressor 112 from the facility 111 is recycled into the injection well 101. The result is better production of oil from the well. The unit 10 may have been returned to a lessor prior to production of the oil, thus reducing the cost of producing the oil.

Figure 2:
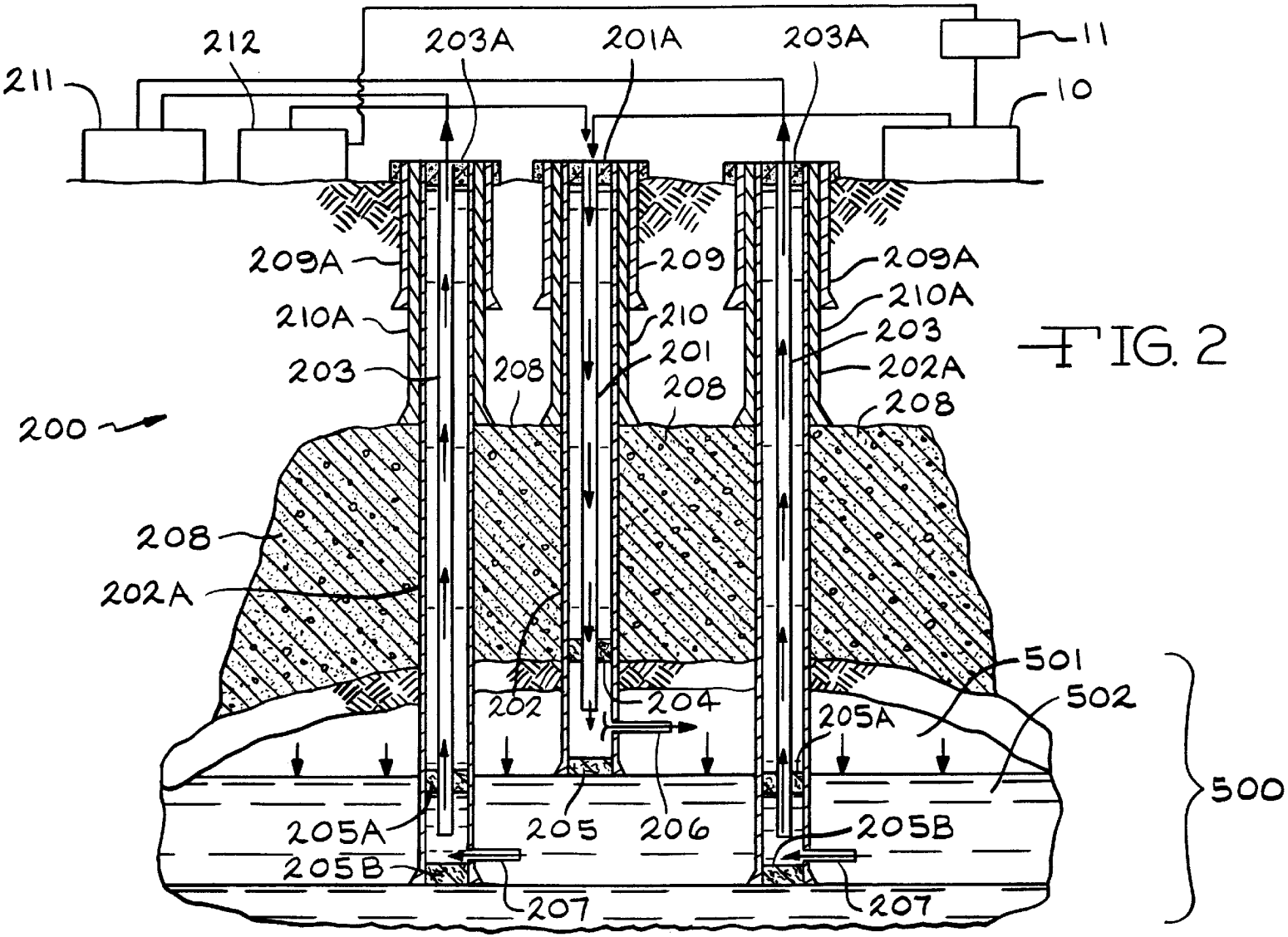

FIG. 2 is similar to FIG. 1 except that an injection well 201 and production wells 203 are spaced a significant distance from the injection well 201. Injection well 201 is provided in the casing 202 which can extend only to above the oil section 502. Packings 204 and 205 are provided in the casing 202 above and between an opening from the well 201A. A lateral injection well 206 is provided from the casing 202. The outer casing 209 and inner casing 210 around casing 202 are provided as in FIG. 1. Well caps 201A and 203A are provided to close the wells 201 and 203. Around the injection well 201 and casing 202 are provided production wells 203. These cement wells 203 include the packings 205A and 205B in the oil section 502 in casing 202A. Production wells 203 are provided in casings 202A. A cement cap 208 is provided as in FIG. 1 as are inner and outer casings 209A and 210A.

In operation gas from the unit 10 is injected through a lateral well 206 into the gas section 501. The oil is forced out the production well 203. The oil is collected in facility 211 and the gas is recompressed by compressor 212 for reintroduction into the injection well 201.

Figure 3:
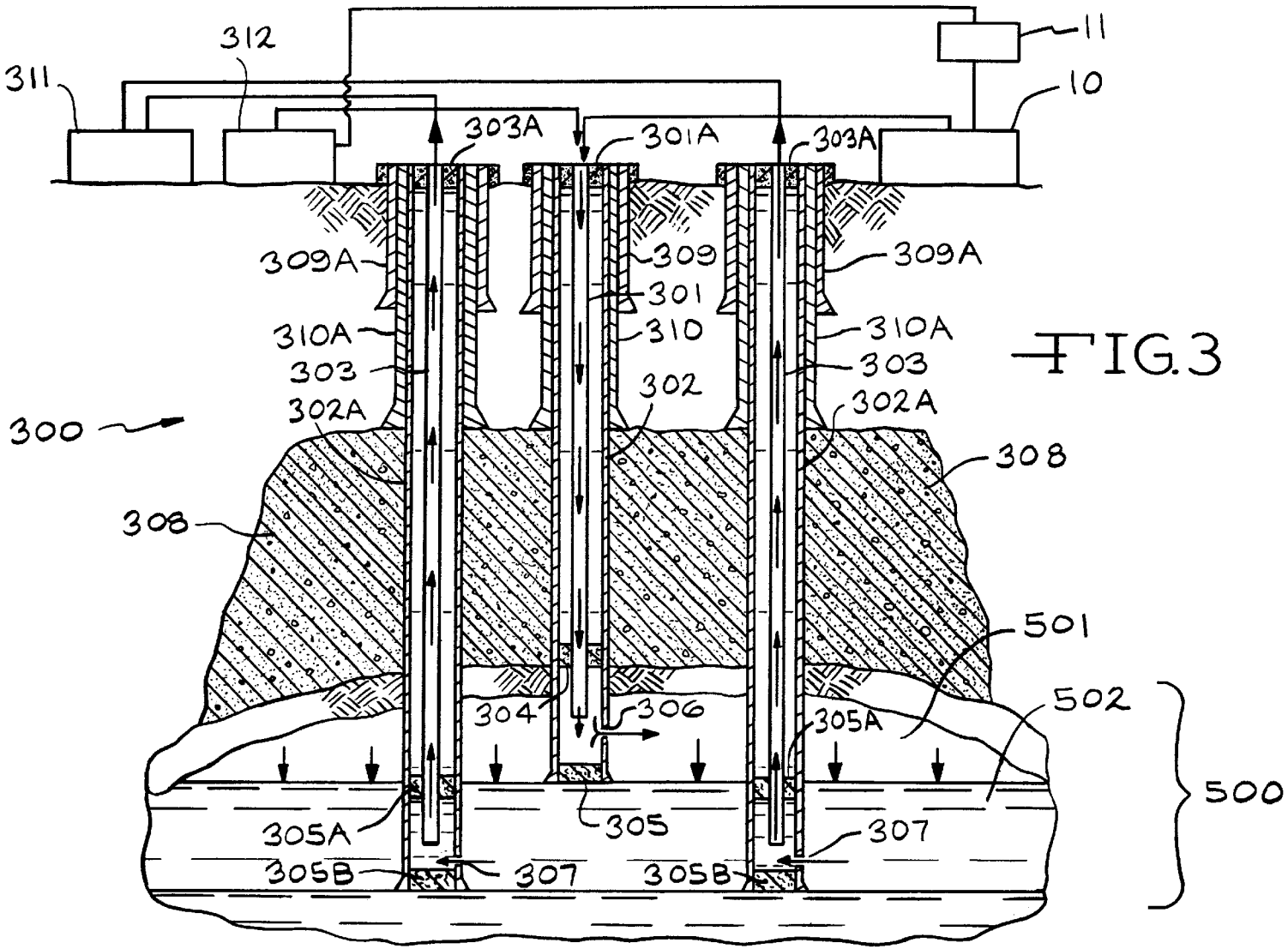

The wells 301 and 303 in FIG. 3 are identical to FIG. 2 except there are no lateral wells 206 and 207 and instead openings 306 and 307 are included. Included are the following common parts: 301—injection well; 301A—well cap; 302—casing; 303—production well; 303A—well cap; 304—packing; 305—packing; 308—cement top; 309—casing; 309A—outer casing; 310—inner casing; 310A—outer casing; 311—facility; and 312—compressor.

This construction is not preferred since there is lower oil production without the lateral wells 206 and 207.

Figure 4:
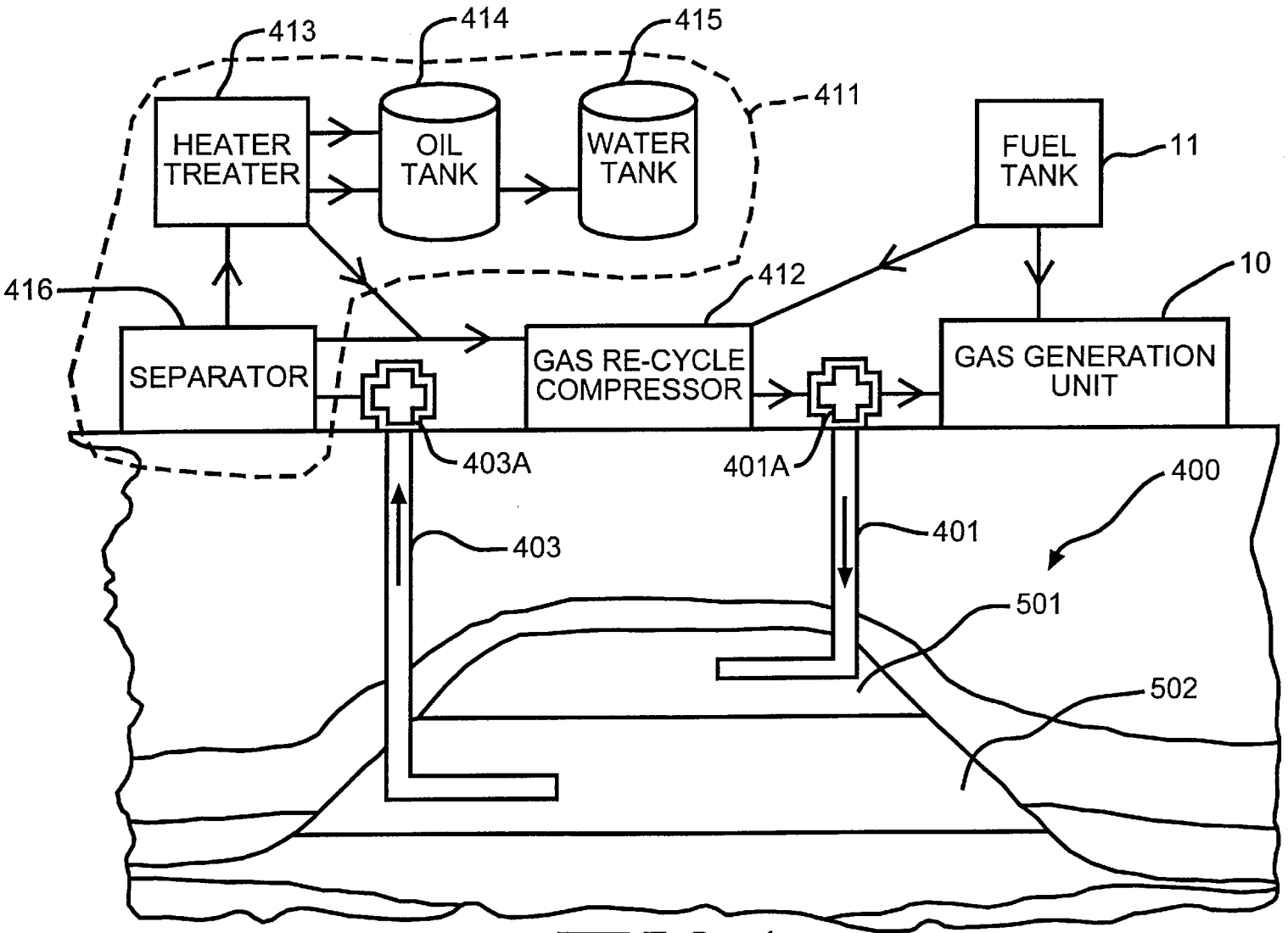

FIG. 4 schematically represents the most preferred embodiment of the present invention. FIG. 4 shows an injection well 401 in gas section 501 and a production well 403 in the oil bearing strata 502. The arrows show the direction of fluid flow. The gas generation unit 10 produces the gas which is injected at well cap 401A. The tank 11 preferably contains propane to fuel the generation unit 10. The production well 403 is below the gas injection well 401 and lateral drilling is used so that the injected gas is dispensed in the gas section 501 and the oil is collected in the oil section 502. In any event, the wells 401 and 402 can have multiple openings along the horizontal sections. The oil is removed at well cap 403A to a separator 416 wherein some exhaust gas is removed and sent to the recycle compressor 412 for injection into well cap 401A. A heater 413 is used to separate gas, oil and water. Gas is also sent to the compressor 412. Oil is sent to tank 414 and water to tank 415.

The separator 416 is standard in the oil industry and is also available from NATCO (Houston, Tex.). The heater 413 is also available from NATCO, for instance. The oil tank 414 is also available from NATCO. The recycle compressor is available from Gas Compressor Services (Traverse City, Mich.) on lease. Preferred is model #JGR/2 from Ariel Compressors (Mount Vernon, Ohio). The gas generation unit 10 is also available on lease from Northland Energy Corporation, Houston, Tex. and is mounted on a wheeled flatbed for over-the-road hauling. The specifications of two available units are shown in Table 1.

TABLE 1

| | Large Unit Configuration | Standard Unit Configuration |
|---|---|---|
| Unit Size | Two Tri Axle Trailers, 10' by 53, each | One 11.5' by 50' skid unit |
| Fuel Trailer Capacity | 35,000 litres | 35,000 litres |
| Discharge Pressure | 2000 p.s.i. (13,800 kPa) | 1,400 psi (9,600 kPa) |
| Flow Rate | 2000 s.c.f.m. (57 $m^3$/min.) | 1,425 s.c.f.m. (41 $m^3$/min.) |
| First Stage Compressor | Frick Screw | Fuller-Kovako Rotary vane compressor[1] |
| Reciprocating Compressor (Booster) | Ariel[2] Four Stage | Gardner Denver[3] WB 14, 4 stage, Radial reciprocating compressor |
| Engine (First Stage) | Caterpillar[4] 3412 (propane) | Cummins[5] G.T.A. 12 (propane) |
| Engine (Booster) | Caterpillar 3412 (propane) | Cummins G.T.A. 28 (propane) |
| Gen Set Capacity 480 Volt 3 Phase | (2) 80 kVa Continuous | 100 kVa Continuous |
| Oxygen Content of Gas | 0.02% or less | 0.02% or less |
| Oxygen Monitoring System | Teledyne[6] Continuous Read Out | Teledyne (Model 326 RA) |
| Corrosion Rate | Less than 2.0 pounds/$ft^2$ per yr. | Less than 2.0 pounds/$ft^2$ per yr. |

Figure 5:
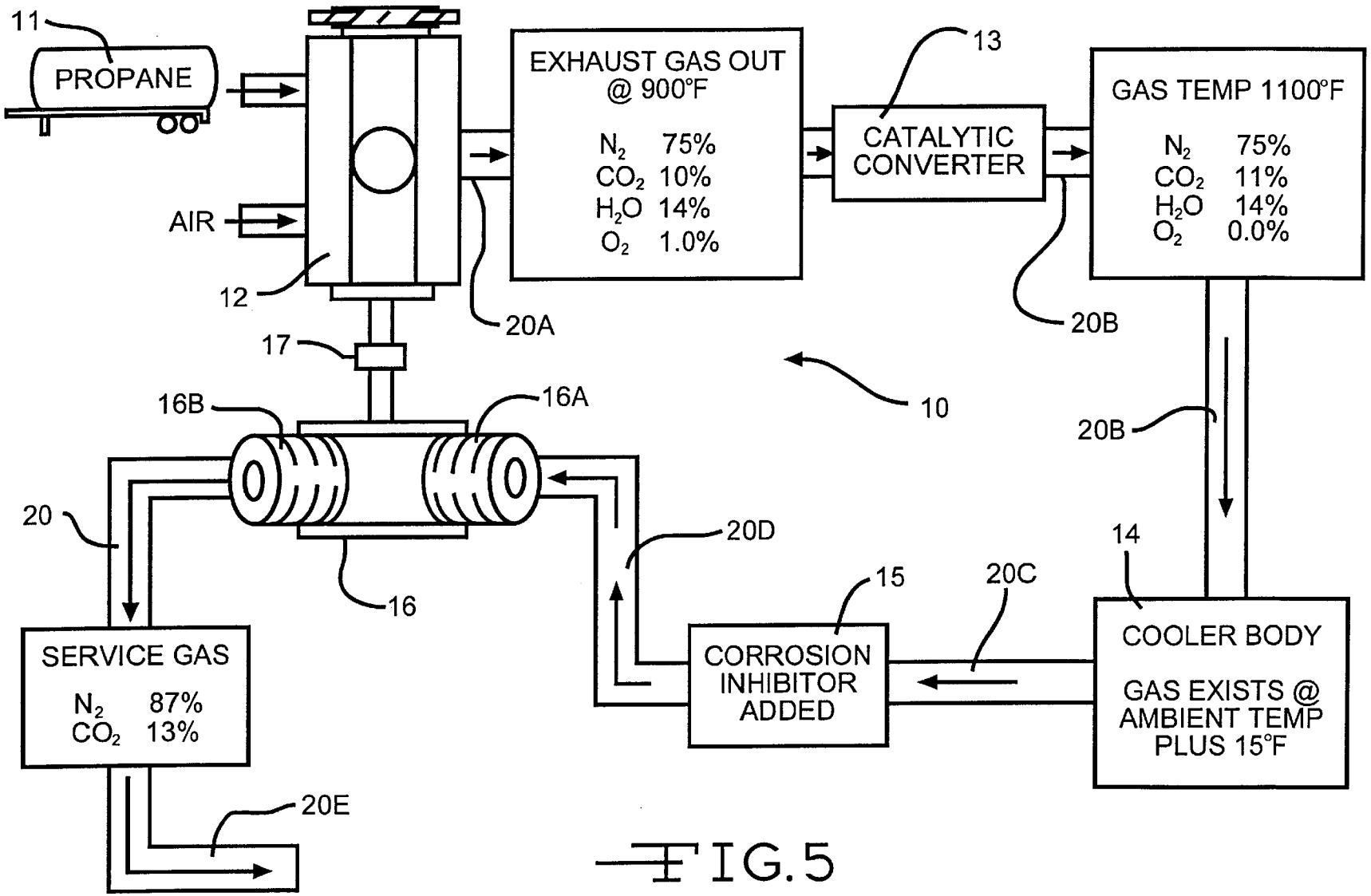
FIG. 5 is a schematic view of the unit 10 which generates the internal combustion engine exhaust.

[1]SCS-Screw Compression Systems Catoosa, OK
[2]Ariel Compressors Mt. Vernon, OH
[3]Gardner Denver Quincy, IL
[4]Caterpillar Peoria, IL
[5]Cummins Columbus, IN
[6]Teledyne Brown Engineering Hunt Valley, MD As shown in FIG. 5, the gas generation unit 10 of FIGS. 1 to 4 includes a fuel (propane) in a tank 11 which is provided to a motor 12 which produces the exhaust in a conduit 20A. A catalytic converter 13 from the conduit 20A leads to a conduit 20B. A cooler body 14 leads to conduit 20C. A corrosion inhibitor injector unit 15 leads to conduit 20D, compressor heads 16A and 16B of compressor 16. A shaft 17 from the motor 12 drives the compressor 16. The outlet through conduit 20E from the compressor 16 is fed into the well of FIGS. 1 to 4. A unit of this type is shown in U.S. Pat. No. 5,663,121 to Moody.

As shown in FIGS. 1 to 4, the tank 11 provides gas to the gas generation unit 10 and to the recycle compressor 112, 212, 312 or 412. The gas generation unit 10 is only on line during the injection to reduce the cost of the project.

The following is a list of vendors and their related services:

(1) Nitrogen-CO/2 Gas Generation Unit: Northland Energy Corporation, 1115 Goodnight Trail, Houston, Tex. 77060–1112;

(2) Packers: Baker Hughes, Inc. (Houston, Tex.);

(3) Cement/Tools: Halliburton Energy Services (Houston, Tex.);

(4) Weatherford International (Houston, Tex.);

(5) Corrosion Inhibitor: M-1 Drilling Fluids (ConQuor 404; phosphate ester salt (Houston, Tex.);

(6) Corrosion Inhibitor: Magnesia, (use as a weight 10% by volume) Martin Marietta (Hunt Valley, M.d.).

It will be appreciated that over time additional gas can be added through the injection well to maintain the desired pressure. This can be done with the recycle compressor. Also corrosion inhibitors can be added to the injection and/or production well over time to prevent corrosion in the injection well.

It is intended that the foregoing description be only illustrative of the present invention and that the present invention be limited only by the hereinafter appended claims.

I claim:

1. A method for enhanced recovery of hydrocarbons containing oil from a subterranean hydrocarbon bearing strata comprising the steps of:

(a) providing an exhaust gas from an internal combustion engine, which gas is compressed by a first compressor connected to the engine motor, wherein the gas consists essentially of nitrogen and carbon dioxide;

(b) injecting the gas from the compressor into an injection well and from the well into a gas bearing strata which is above the hydrocarbon bearing strata, without injection of the exhaust gas directly into the hydrocarbon bearing strata from the injection well which increases pressure in the oil bearing strata;

(c) recovering the hydrocarbons and the exhaust gas from a production well in the hydrocarbon bearing strata;

(d) separating the hydrocarbons from the recovered exhaust gas; and (e) compressing the recovered exhaust gas with a second compressor and injecting the compressed recovered exhaust gas into the injector well.

2. The method of claim 1 wherein the exhaust gas injected into the injection well contains by volume about 87 percent nitrogen, about 13 percent carbon dioxide with a minor amount of a corrosion inhibitor.

3. The method of claims 1 or 2 wherein the gas is cooled to between about 80 and 150° F. prior to the injecting in step (b).

4. The method of claims 1 or 2 wherein the gas is pressurized to between about 1000 and 3000 psi in the injection well.

5. The method of claims 1 or 2 wherein the fuel for the internal combustion engine is propane.

6. The method of claims 1 or 2 wherein a packing means is provided in a casing around the injection well above and optionally below the gas bearing strata so that the exhaust gas is injected into the gas bearing strata.

7. The method of claim 1 wherein the separating is by heating the hydrocarbons to volatilize exhaust gas from the oil.

8. An oil producing well system for enhanced recovery of hydrocarbons including oil from a subterranean bearing strata which comprises:

(a) an injection well for injecting a compressed exhaust gas from an internal combustion engine, which is connected to a compressor for the exhaust gas, into a gas bearing strata which is above the hydrocarbon bearing strata, without injection of the exhaust gas directly into the hydrocarbon bearing strata from injection well;

(b) a production well in spaced relationship to the injection well and extending into the hydrocarbon bearing strata for recovering the exhaust gas and hydrocarbons from the hydrocarbon bearing strata;

(c) a separation facility above the production well for separating the hydrocarbons from the exhaust gas and recovering the exhaust gas;

(d) separating the hydrocarbons from the recovered exhaust gas; and (e) compressing the recovered exhaust gas with a second compressor and injecting the compressed recovered exhaust gas into the injector well.

9. The system of claim 8 wherein a packing means is provided in a casing around the injection well above and below the gas bearing strata so that the exhaust gas is injected into the gas bearing strata.

10. The system of claim 8 wherein the packing means is cement for the packing means below the gas bearing strata.

11. The system of claims 8 or 9 wherein the compressor can provide the gas at 1000 to 3000 psi in the injection well.

12. The system of claims 8 or 9 wherein the separation facility separates the oil from the gas by heating the hydrocarbons to volatilize the exhaust gas from the oil.

13. The system of any one of claims 8, 9 or 10 wherein the engine is adapted to be powered by propane from a mobile source of propane.

14. The method of claim 1 wherein the gas is stabilized to prevent corrosion in the injection well before injection.

15. The method of claim 1 wherein the gas from the first compressor is periodically injected into the well to maintain the pressure in the injection well.

* * * * *